US005213779A

United States Patent [19]

Kay et al.

[11] Patent Number: 5,213,779

[45] Date of Patent: May 25, 1993

[54] PROCESS FOR OPTIMIZING THE REMOVAL OF $NO_X$ AND $SO_X$ FROM GASES UTILIZING LANTHANIDE COMPOUNDS.

[75] Inventors: D. Alan R. Kay, Burlington, Canada; William G. Wilson, Pittsburgh, Pa.; Vinod Jalan, Concord, Mass.

[73] Assignee: Gas Desulfurization Corporation, Pittsburgh, Pa.

[21] Appl. No.: 738,893

[22] Filed: Aug. 1, 1991

Related U.S. Application Data

[60] Continuation-in-part of Ser. No. 290,392, Dec. 29, 1988, abandoned, which is a continuation-in-part of Ser. No. 100,291, Sep. 23, 1987, Pat. No. 4,885,145, which is a continuation-in-part of Ser. No. 846,272, Mar. 31, 1986, Pat. No. 4,714,598, which is a division of Ser. No. 718,989, Apr. 2, 1985, Pat. No. 4,604,268, which is a continuation-in-part of Ser. No. 521,751, Aug. 8, 1983, Pat. No. 4,507,149, which is a continuation-in-part of Ser. No. 471,773, Mar. 3, 1983, abandoned, which is a continuation of Ser. No. 174,024, Jul. 31, 1980, Pat. No. 4,397,683.

[51] Int. Cl.[5] ..... B01J 8/00; C01B 7/00; C01B 17/00; C01B 21/00

[52] U.S. Cl. ..... 423/239; 423/244.02; 423/244.09

[58] Field of Search ..... 423/244 R, 239, 351

[56] References Cited

U.S. PATENT DOCUMENTS

| | | | |
|---|---|---|---|
| 3,885,019 | 5/1975 | Matsushita et al. | 423/213 |
| 3,914,390 | 10/1975 | Kudo et al. | 423/239 |
| 4,115,516 | 9/1978 | Takami et al. | 423/239 |
| 4,251,496 | 2/1981 | Longo et al. | 423/239 |
| 4,369,108 | 1/1983 | Bertolacini et al. | 423/239 |

OTHER PUBLICATIONS

K. Barron, A. H. Wu and L. D. Krenzke, "The Origin and Control of $SO_x$ Emissions From FCC Unit Regenerators", Symposium on Advances In Catalytic Cracking, American Chemical Society, Aug. 28-Sep. 2, 1983.

Church et al., Catalysts Formulation, 1960 to Present, S.A.E. Technical Paper Series, Paper 890815, presented Int. Cong. & Exposition, Feb. 27-Mar. 3, 1989.

Folsom et al., Gas-Reburning-Sorbent Injection For $NO_x$ and $SO_2$ Control, 1988.

Hardee et al., "Nitric Oxide Reduction By Methane Over $Rh/Al_2O_3$ Catalysts", 86 Journal of Catalysis, pp. 137-146 (1984).

Haslbeck et al., "A Pilot-Scale Test of the NOXSO Flue Gas Treatment Process", Jun. 1988.

Scherzer, "Rare Earths and Cracking Catalysts", Rare Earths, Extraction, Preparation and Applications, The Minerals, Metals & Matrial Society, 1988, pp. 317-331.

Stelman et al., "Simultaneous Removal of $NO_x$, $SO_x$, and Particulates From Flue Gas By A Moving Bed of Copper Oxide", United States Department of Energy, Pittsburgh Energy Technology Center, Contract DE-AC22-83PC60262, 1981.

*Primary Examiner*—Gregory A. Heller
*Attorney, Agent, or Firm*—Buchanan Ingersoll

[57] ABSTRACT

A process for optimizing the removal of nitrogen oxide ($NO_x$) and sulfur oxide ($SO_X$) from flue gases is provided in which the flue gases pass over a lanthanide-oxygen-sulfur catalyst. The catalyst has active sites provided on its surface which promote the dissociation of $NO_X$ and receive and entrap oxygen released during the dissociation of the $NO_X$. While the flue gases pass over the catalyst, a reducing gas contacts the catalyst to reduce the oxygen on the active sites of the catalyst and permit the catalyst to continue to promote the dissociation of the $NO_x$ in the flue gas. If the flue gases contain $SO_X$, they are then passed over a solid solution having a solvent of a first lanthanide oxide compound which crystallizes in the fluorite habit and a solute of at least one altervalent oxide of a second lanthanide. The $SO_X$ in the flue gases reacts with the solid solution to form a sulfated lanthanide oxide which is removed from the flue gases. The sulfated lanthanide oxide may then be dissociated by raising its temperature to regenerate the lanthanide oxide.

28 Claims, 4 Drawing Sheets

PROCESS FOR OPTIMIZING THE REMOVAL OF $NO_X$ AND $SO_X$ FROM GASES UTILIZING LANTHANIDE COMPOUNDS

BACKGROUND OF THE INVENTION

Field of the Invention

This application is a continuation-in-part of copending application, U.S. Ser. No. 290,392, filed Dec. 29, 1988, now abandoned, which was a continuation in part of patent application 100,291 filed Sep. 23, 1987 now U.S. Pat. No. 4,885,145 which was a continuation-in-part of application Ser. No. 846,272 filed Mar. 31, 1986, now U.S. Pat. No. 4,714,598, which was a division of application Ser. No. 718,989 filed Apr. 2, 1985 now U.S. Pat. No. 4,604,268, which was a continuation-in-part of application Ser. No. 521,751 filed Aug. 8, 1983, now U.S. Pat. No. 4,507,149 which was a continuation-in-part of application Ser. No. 471,773 filed Mar. 3, 1988, now abandoned which was a continuation of application Ser. No. 174,024 filed Jul. 31, 1980 now U.S. Pat. No. 4,397,683.

This invention relates to a process for optimizing the removal of the oxides of nitrogen ($NO_x$) from gases created by the combustion of carbon and hydrocarbons. This invention further relates to a process for optimizing the removal of both $NO_x$ and oxides of sulfur ($SO_x$) from gases created by the combustion of sulfur containing carbon and hydrocarbons.

Description of the Prior Art

Processes for the simultaneous removal of $NO_x$ and $SO_x$ from gases are known. U.S. Pat. No. 4,251,496 to Longo describes a combination process which uses cerium (one of the lanthanides) oxide for the simultaneous removal of both $NO_x$ and $SO_x$ from oxidizing gaseous mixtures in the presence of ammonia at temperatures ranging from 500° C. to 700° C. The process for removing both $NO_x$ and $SO_x$ may be conducted in one reaction zone or in a plurality of zones at temperatures of 500° C. to 700° C. FIG. 1 herein is prepared from the data in Table II of Longo. FIG. 1 shows that maximum $SO_x$ removal is achieved when there is minimum $NO_x$ removal and maximum $NO_x$ removal is achieved when there is minimum $SO_x$ removal.

Stelman, D., et. al., "Simultaneous Removal of $NO_x$, $SO_x$, and Particulates From Flue Gas By A Moving Bed Of Copper Oxide" U.S. Department of Energy, Pittsburgh Energy Technology Center, Contract DE-AC22-83PC60262 discloses a process for the simultaneous removal of $NO_x$ and $SO_x$. FIG. 12 from this report shows minimum $NO_x$ removal when there is maximum $SO_x$ removal and minimum $SO_x$ removal when there is maximum $NO_x$ removal Stelman uses copper suliate as a catalyst for $NO_x$ and $SO_x$ removal rather than a lanthanide based compound.

In addition, other prior art references describe methods of $NO_x$ removal utilizing cerium oxide without the simultaneous removal of $SO_x$ U.S. Pat. No. 4,115,516 to Takami et. al. describes a method for removing $NO_x$ from compressed exhaust gas from a pressurized absorption type nitric acid plant without the precipitation of ammonium nitrate in the piping system of the process. Two of the catalysts identified as being capable of achieving these objectives are cerium oxide and cerium sulfate. However, under the conditions of the described process, the cerium sulfate is calcined to form cerium oxide before it functions as a catalyst. Takami et. al. does not indicate whether cerium oxide or calcined cerium sulfate is superior in performance as a catalyst for $NO_x$ reduction. The gases from which Takami et. al. removes $NO_x$ do not contain $SO_x$.

U.S. Pat. No. 3,885,019 to Matsushita et. al. describes a process whereby the oxides of nitrogen in an exhaust gas are reductively decomposed over a catalyst of cerium oxide or vanadium oxide in the presence of ammonia. The cerium oxide catalyst is created by the calcination of cerium nitrate, cerium chloride, cerium sulfate, cerium ammonium nitrate or mixtures thereof. The ability of cerium oxide ($CeO_2$) alone to catalyze the reduction of $NO_x$ by ammonia ($NH_3$) is described in Table 1 of Matsushita et. al. which shows an average reduction of $NO_x$ of 60.8% over a temperature range from 320° C. to 440° C. Reduction as high as 95.8% of $NO_x$ was achieved when the support on which the $CeO_2$ was deposited was subjected to exposure to various mineral acids before the $CeO_2$ was deposited on the support. The ratio of $NH_3$ to $NO_x$ used for the reduction of $NO_x$ was 1.5, which permits ammonia slip of such a magnitude that it could constitute an environmental hazard.

Lanthanides other than cerium have been used as catalysts. Scherzer, Julius, "Rare Earths in Cracking Catalysts", Rare Earths, Extraction, Preparation and Applications, The Minerals, Metals & Materials Society, 1988, describes the use of lanthanum oxide catalysts in preference to cerium oxide catalysts for cracking and hydrocracking during the manufacture of gasoline. K. Baron, A. H. Wu and L. D. Krenzke, "The Origin and Control of $SO_x$ Emissions from FCC Unit Regenerations", Symposium on Advances in Catalytic Cracking, American Chemical Society, Aug. 28–Sep. 2, 1983, discusses the use of lanthanum oxide as a "$SO_X$ gettering" catalyst in Fluid Bed Catalytic Crackers in oil refineries.

Church, M. L., et. al., "Catalyst Formulations 1960 to Present" SAE Technical Paper Series, Paper 890815, Presented Int. Cong. & Exposition, Feb. 27–Mar. 3, 1989 describes the fundamentals of catalytic action. Church uses a noble metal as the catalyst for the $NO_x$ reduction Hardee, J. R. et. al., "Nitric Oxide Reduction By Methane Over $Rh/Al_2O_3$ Catalysts", 86 Journal of Catalysis, pages 137–146 (1984) discloses the use of reducing gases other than ammonia for the reduction of $NO_x$.

SUMMARY OF THE INVENTION

In the prior art described above the simplistic chemical equation for the catalytic reduction of $NO_x$ can be written:

$$6NO(g)+4NH_3(g)=5N_2(g)+6H_2O \quad (1)$$

However, at any temperature at which the catalytic reduction of $NO_x$ is conducted, thermodynamic calculations indicate nearly complete dissociation of both $NH_3$ and NO which is the major component of $NO_x$. Reaction (1) is kinetically controlled and can be described according to the concepts of Church, M. L., et. al. in the reference above.

On the basis of this concept, it can be inferred that the active sites on the catalyst are promoting the dissociation of NO (the major component of $NO_x$). However in the process, the active site on the catalyst responsible for promoting the dissociation is rendered inactive because the oxygen released is chemisorbed on the active site. Furthermore, when the oxygen formed by dissociation of NO is chemisorbed on the catalyst, the hydrogen released by the dissociation of the ammonia reacts preferentially with the oxygen on the catalyst instead of the oxygen in the flue gas clearing the active site so that it can against promote the dissociation of NO.

If, after the dissociation of the NO, the active site is rendered inactive because of the nitrogen released by the dissociation was chemisorbed on the active site, the hydrogen from the dissociation of ammonia would have to combine with the nitrogen to form $NH_3$ (which is the most chemically stable of the combinations of nitrogen and hydrogen). However, it has been stated above that $NH_3$ dissociates at the temperatures at which the catalytic reduction of $NO_x$ occurs, therefore, the element making the active site inoperative has to be oxygen.

In accordance with this invention, there is provided a process which optimizes the catalytic dissociation of $NO_x$ and provides a reducing gas which removes the oxygen from the active sites on the catalyst. This permits the catalyst to continue to function as a promoter of the dissociation of $NO_x$ In this process, the lanthanide containing catalyst used for $NO_x$ removal is a lanthanide oxygen sulfur compound whose ability to remove $SO_x$ from the gaseous mixtures has been diminished from its maximum. The temperatures of the gaseous mixtures from which the $NO_x$ is to be removed are controlled according to their $SO_2$ content to prevent the dissociation of the lanthanide-oxygen-sulfur compound either entirely or in part to a lanthanide-oxygen compound which is a less effective catalyst for the $NO_x$ dissociation. Preferably, the removal of $NO_x$ is carried out in one site and the removal of $SO_x$ is carried out at a separate site. In such a process, the $NO_x$ is dissociated first and the $SO_x$ is removed later. Cerium oxide ($CeO_2$) or solid solutions of $CeO_2$ and other altervalent oxides which contain oxygen ion vacancies are used for the removal of $SO_x$ from gases created by the combustion of carbon and hydrocarbons which contain sulfur. These solid solutions increase the rate and extent of $SO_x$ removal from flue gas.

A further preferred embodiment of this invention uses a lanthanide-oxygen-sulfur compound whose dissociation temperature is higher than that of the cerium-oxygen-sulfur [$Ce_2(SO_4)_3$] when the composition and temperature of the gases from which $NO_x$ is to be removed are low in $SO_2$ and high in temperature.

A further preferred embodiment of this invention places the lanthanide-oxygen sulfur catalyst necessary to promote the dissociation of $NO_x$ on a substrate, such as a pellet or zeolite, by means of an aqueous/liquid solution of the lanthanide-oxygen sulfur compound rather than to form a lanthanide-oxygen-sulfur compound from a lanthanide-oxygen precursor which is exposed to gases containing $SO_2$ to create the lanthanide-oxygen-sulfur compound.

A further preferred embodiment of this invention is when the lanthanide oxygen-sulfur catalyst of this invention becomes less effective or inoperative to promote the dissociation of $NO_x$, the substrate being used can be recoated with another coating of the aqueous/-liquid solution of the lanthanide-oxygen-sulfur compound. When the coating is dried, the catalytic action has been restored.

DESCRIPTION OF THE PREFERRED EMBODIMENTS

The present invention is directed to the removal of $NO_x$ from oxygen containing gases resulting from the combustion of carbon and hydrocarbons, which may or may not contain sulfur, that are known generically as "flue gases" or "exhaust gases". The terms "flue gases" and "exhaust gases" will be used hereafter to describe such gases.

Figure 1:
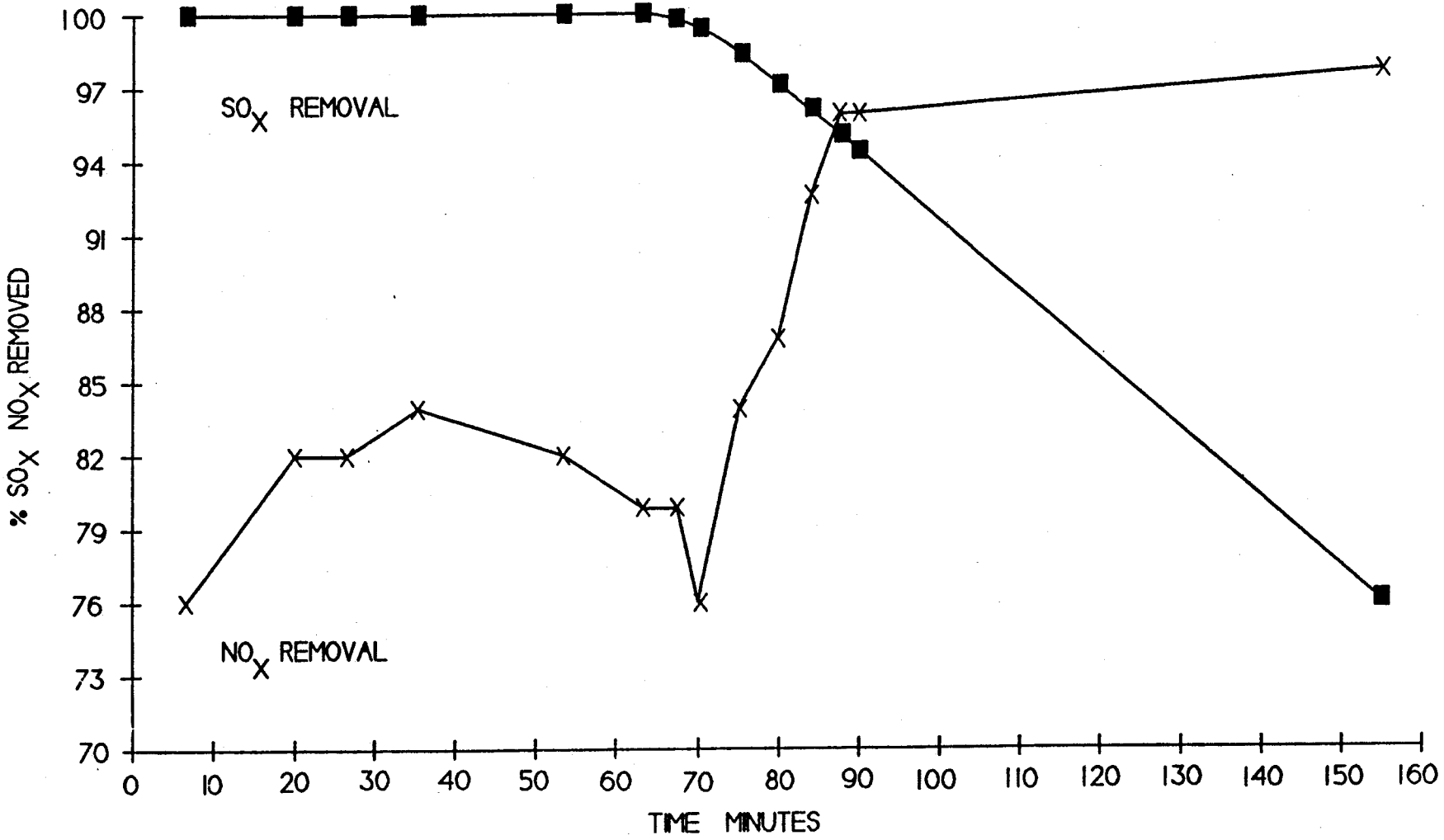
FIG. 1 is prepared from the data in Table II of U.S. Pat. No. 4,251,496 which shows that maximum $NO_x$ reduction is achieved with cerium-oxygen-sulfur compounds only when $SO_x$ removal is greatly reduced from it maximum value.

In order to optimize the removal of $NO_x$ and $SO_x$ from flue gases which contain $SO_2$, $NO_x$ and $O_2$ resulting from the combustion of carbon and hydrocarbons, the lanthanide-oxygen-sulfur that functions as a catalyst for the dissociation of $NO_x$ is no longer capable of achieving maximum $SO_2$ removal FIG. 1, which is compiled from Table II of U.S. Pat. No. 4,251,496, shows that in a process for the simultaneous removal of $NO_x$ and $SO_x$, the maximum reduction of $NO_x$ (98%) was achieved after the ability of $CeO_2$ used for the removal of $SO_2$ had dropped from a high of 99% $SO_2$ to 76.6%. Table II in Longo further shows a maximum of 97.1% conversion of $CeO_2$ to $Ce_2(SO_4)_3$ at 89 minutes into the run and maximum $NO_x$ removal came after 155 minutes when $SO_2$ removal was only 76.6%. The gases represented in FIG. 1 originally contained 3000 ppm $SO_2$ and 225 ppm $NO_x$. The test represented in FIG. 1 was conducted at 600° C. with a ratio of $NH_3/SO_2$ of 2/1.

Figure 2:
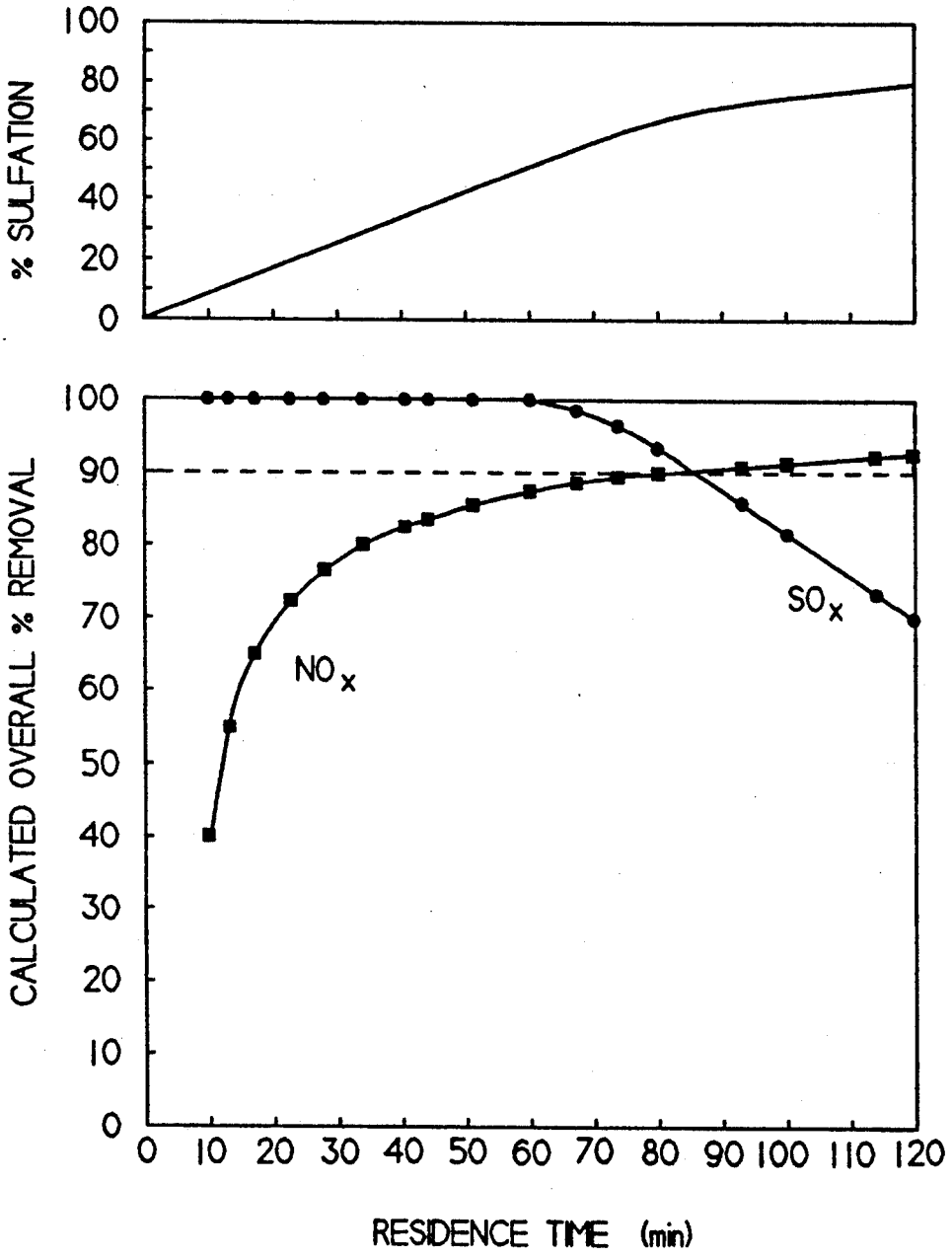
FIG. 2 shows that maximum $NO_x$ reduction is achieved with $CuSO_4$ only when $SO_x$ removal is greatly reduced from its maximum value.

The same relationship between $SO_x$ and $NO_x$ removal is shown in FIG. 2 representing the removal of $SO_x$ from flue gas and the catalytic dissociation of $NO_x$ with ammonia after the copper oxide is no longer capable of maximum removal of $SO_2$ The fact that both the sulfates of cerium and copper can catalyze the dissociation of $NO_x$ is evidence that other sulfates should be equally capable of catalyzing the reduction of $NO_x$.

Figure 3:
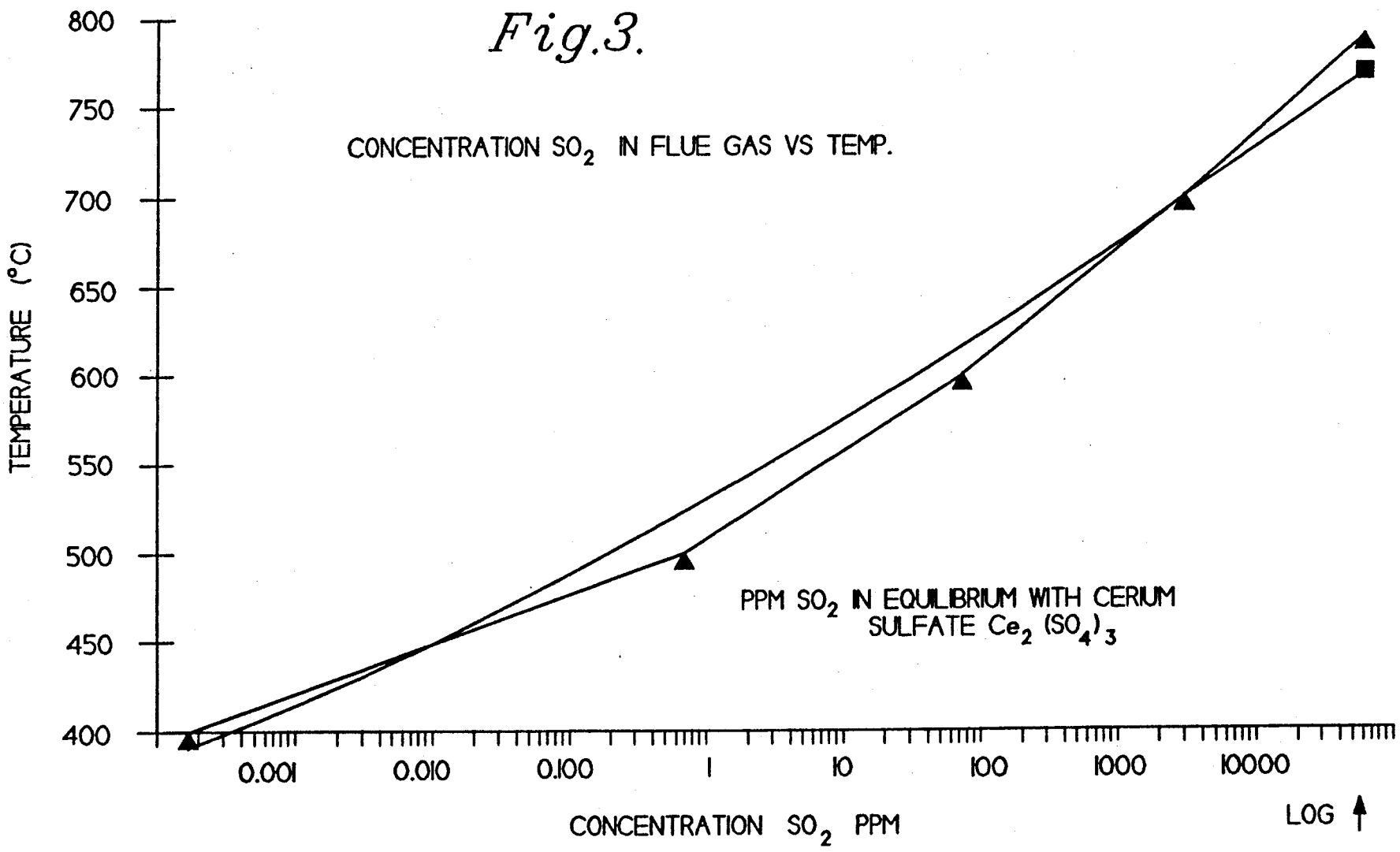
FIG. 3 shows the amount of $SO_2$ in a flue gas containing 3.7% $O_2$ in equilibrium with cerium sulfate $Ce_2(SO_4)_3$ at various temperatures.

The stability of the lanthanide-oxygen-sulfur compound which controls the extent of $NO_x$ dissociation is in turn from which the $NO_x$ is to be removed. FIG. 3 presents the results of equilibrium calculations which describe the concentration of $SO_2$ in a flue gas containing 3.5% $O_2$ that is required to prevent the dissociation of $Ce_2(SO_4)_3$ as a function of temperature. When the integrity of the $Ce_2(SO_4)_3$ has been preserved, it is then capable of achieving maximum $NO_x$ removal as shown in FIG. 1.

Maximum $NO_x$ dissociation at any temperature and particularly at higher temperatures is achieved when the $NO_x$ is removed from the flue gases first and any $SO_2$ in the gas serves to prevent the dissociation of the lanthanide-oxygen-sulfur compounds which serves as a catalyst for the dissociation of $NO_x$ When $NO_x$ removal from flue gases is required at high temperatures from gases which do not contain sufficient $SO_2$ to prevent the dissociation of the cerium-oxygen sulfur compound necessary to catalyze the dissociation of $NO_x$ with a reducing gas, a lanthanide-oxygen-sulfur compound must be used which has a higher dissociation temperature than $Ce_2(SO_4)_3$.

The reduction of oxygen from the active sites of the catalyst which permits the continuation of the dissociation of $NO_x$ can be achieved with reducing gases such as $H_2$ which results from the dissociation of gases rich in hydrogen such as ammonia ($NH_3$) and methane ($CH_4$) These reducing gases may be separately added to the flue gases or, if the gas containing carbon and hydrocarbons is burned in an appropriate manner, may be a constituent of the flue gases.

The lanthanide oxides used for the removal of $SO_2$ crystallize in the fluorite habit. When altervalent anions of other lanthanide oxides or oxides of the alkaline earth element are in solid solution in lanthanide oxides which crystallize in the fluorite habit, oxygen ion vacancies are created in the solid solution which enhance its ability to remove $SO_2$ from flue gases.

It is well known to those skilled in the art that pellets, granules or coatings on substrates may be damaged or destroyed if the pellets, granules or coatings on a substrate undergo a change in composition, density, crystal structure, or size of the crystal lattice between the compounds before and after reaction. As an example, if cerium oxide ($CeO_2$) is used as a precursor to create pellets, granules or coatings of cerium sulfate ($Ce_2(SO_4)_3$) on a substrate, the $CeO_2$ deposited on the substrate has a density of 7.123 g/cc and its crystal habit is fluorite. However, $Ce_2(SO_4)_3$ has a density of 3.192 g/cc and its crystal habit is either monoclinic or rhombic. Therefore, the integrity of a coating of $Ce_2(SO_4)_3$ on a substrate created by applying $Ce_2(SO_4)_3$ from an aqueous/liquid solution of the compound to the substrate should be better than a coating of $Ce_2(SO_4)_3$ on the substrate created by coating the substrate with $CeO_2$ and exposing it to gases containing $SO_2$ and $O_2$ which would convert it to $Ce_2(SO_4)_3$.

Cerium has been used to illustrate the principles of the present invention. The use of cerium in the explanation of the present invention does not preclude the use of other lanthanides in the present invention in place of all or part of the cerium.

The reaction for the removal of $NO_x$ created by the combustion of carbon and hydrocarbons which may or may not contain sulfur which is catalyzed by the lanthanide-oxygen-sulfur compounds is:

$$2NO(g)=N_2(g)+O_2(g) \quad (2)$$

Thermodynamic calculations predict that NO is unstable at all temperatures below that at which it is formed. However, the kinetics of that reaction are such that the dissociation does not take place unless it is catalyzed. When properly catalyzed, reaction (2) takes place rapidly with $N_2$ being released into the gas stream from which it came, but the oxygen is retained on the active sites of the catalyst. Therefore, a reducing gas must be added to the gas stream which is capable of reducing the oxygen on the active sites of the catalyst so those sites are again operative in the promotion of the dissociation of $NO_x$. Ammonia has been the common source of the hydrogen used for the selective catalytic reduction of $NO_x$ because it dissociates almost completely at the low temperatures conventionally used for the selective catalytic reduction of $NO_x$. Because the oxygen on the active sites of the catalyst shares bonds with the catalyst, it is more easily reduced by the hydrogen than the oxygen that is in the flue gas.

Although ammonia has been the preferred source of hydrogen for the reduction of oxygen on the active sites of catalysts, hydrocarbons which dissociate at the temperatures at which catalytic reduction of $NO_x$ takes place are available. The data presented in FIG. 1 was obtained at a temperature of 600° C. (1112° F.) At that temperature, 98% $NO_x$ removal was achieved from simulated flue gases whose $SO_2$ concentration was 0.03% or 3000 ppm. The data in FIG. 3 indicates that the catalyst, $Ce_2(SO_4)_3$, will not dissociate under these conditions. Typically, catalysts for $NO_x$ reduction have operated at temperatures between 304° C. and 398° C. (580° F. and 750° F.) because of the possibility of physical and chemical changes to the catalyst that could reduce its ability to promote the dissociation of $NO_x$ if operated outside of that temperature range. Equilibrium calculations indicate the composition of gases resulting from the dissociation of methane are: (1) at 1200° F. 75% of the methane would have dissociated, and the hydrogen content of the resulting gases would be 50%; and (2) at 580° F. (the lowest operating temperature of conventional catalysts) there would only be 66% dissociation of the $NH_3$ and the hydrogen content of the resulting should increase with increasing temperature.

Although the ammonia may be preferred as a reductant for the oxygen remaining on the catalyst because it dissociates more completely, the cost of an equal amount of $H_2$ from dissociation of $CH_4$ would be lower.

When the source of hydrocarbon is coal, the typical composition of the gases resulting from its combustion in the boiler of a power plant are: $CO_2$ 13.21%, $H_2O$ 9.21%, $N_2$ 73.48%, $SO_2$ 0.35%, $O_2$ 3.74%, HCl 0.01%, and $NO_x$ 0.05%. When the hydrocarbon is natural gas or methane the typical analysis of the flue gas resulting is: $NO_x$ 96 ppm, CO 100 ppm, $CO_2$ 8.15%, $O_2$ 0.63%, $H_2O$ 16.3%, $N_2$ 72.56%, and $SO_2$ 2 to 3 ppm. All of the catalysts for the reduction of $NO_x$ must operate within this kind of chemical environment.

In many instances, the catalysts used for the dissociation of $NO_x$ are based on either the oxides of the metals or the sulfates of the metals. The curves in FIGS. 1 and 2 show that maximum $NO_x$ dissociation is achieved when the catalyst is a sulfate of the metal. Therefore the reaction of the catalyst with the $SO_2$ of the gases and the dissociation temperature of the resulting metal sulfate is of extreme importance. As an example the equation for the formation of $Ce_2(SO_4)_3$ from a flue gas containing $SO_2$ and $O_2$ may be written:

$$\tfrac{1}{2}CeO_2(s)+SO_2(g)+1/3O_2(g)=\tfrac{1}{2}Ce_2(SO_4)_3(s) \quad (3)$$

$$\Delta G^\circ=-63000+50.0T \quad (4)$$

Equilibrium calculations using the thermodynamic information in equation (4) can determine the amount of $SO_2$ required in flue gases to prevent the dissociation of $Ce_2(SO_4)_3$. The results of these calculations are shown graphically in FIG. 3. At any temperature between 400° C. and 800° C., the $SO_2$ concentration of flue gas containing a normal amount of $O_2$(approximately 3–4%) must be equal to or greater than the equilibrium value shown on this curve to prevent the dissociation of $Ce_2(SO_4)_3$. Therefore, any attempt at simultaneous $NO_x$ and $SO_x$ removal of 95% or greater is impossible. This principle is illustrated in FIG. 1 which shows:

1. when there is maximum $SO_2$ removal, $NO_x$ dissociation is limited (less than 85%) because the $CeO_2$ has not been converted completely to $Ce_2(SO_4)_3$.
2. maximum $NO_x$ dissociation (approximately 98%) is attained when the $CeO_2$ has been almost completely converted to $Ce_2(SO_4)_3$ which is the most effective cerium-containing catalyst, but its ability to remove $SO_2$ has been lowered to less than 80%. U.S. Pat. No. 4,251,496 states that the compound formed when $CeO_2$ is exposed to $SO_2$ is cerium oxysulfate, but there is no thermodynamic information to substantiate the formation of cerium oxysulfate.

Regeneration of the $Ce_2(SO_4)_3$ formed by the desulfurization of flue gases is achieved by increasing the temperature and removing any $SO_2$ from contact with the $Ce_2(SO_4)_3$ which permits reaction (3) to reverse with the formation of $CeO_2$, $SO_2$, and $O_2$ It has been determined experimentally that dissociation of $Ce_2(SO_4)_3$ occurs rapidly at temperatures greater than 780° C. (1436° F.).

The information shown in FIG. 2 indicates that $CuSO_4$ is not as effective a catalyst for the dissociation of $NO_x$ as $Ce_2(SO_4)_3$ $CuSO_4$ catalyzes the dissociation of $NO_x$ to achieve just over 90% $NO_x$ removal compared to $Ce_2(SO_4)_3$ which catalyzes the dissociation to achieve 98% $NO_x$ removal. Although the $CuSO_4$ is not as effective a catalyst as $Ce_2(SO_4)_3$, the fact that both of these sulfates do catalyze the reduction of $NO_x$ indicates that other sulfates are candidates as catalysts for $NO_x$ removal.

The dissociation temperature for various sulfates and oxy-sulfates has been calculated based on thermodynamic data similar to those shown for equation (4). For these calculations the dissociation temperature has been defined as the temperature at which the pressure of the gases released by dissociation is one atmosphere. The dissociation temperature of some sulfates and oxy sulfates is shown below:

TABLE I

| Compound | Dissociation Temperature °C. |
|---|---|
| $La_2O_2SO_4$ | 1670 |
| $Pr_2O_2SO_4$ | 1578 |
| $Nd_2O_2SO_4$ | 1567 |
| $Sm_2O_2SO_4$ | 1525 |
| $CaSO_4$ | 1183 |
| $MgSO_4$ | 1014 |
| $Ce_2(SO_4)_3$ | 922 |
| $CuSO_4$ | 650 |

Calculations performed in the same manner and with the same assumption of 3.7% $O_2$ composition in flue gases indicate that $CuSO_4$ requires more $SO_2$ to be in equilibrium with it to prevent dissociation than is required to keep $Ce_2(SO_4)_3$ from dissociation. However, the higher the dissociation temperature the smaller should be the amount of $SO_2$ in contact with the sulfate necessary to prevent dissociation.

Calculations performed in the same manner and with the same assumption of 3.7% $SO_2$ composition in the flue gas indicate that $La_2O_2SO_4$, which is the most likely lanthanum sulfate to form from lanthanum oxide in the presence of flue gases, would require little $SO_2$ in the gas to prevent dissociation. The result of these calculations are shown in TABLE II:

TABLE II

| Temperature | Amount $SO_2$ Required To Prevent Dissociation of $La_2O_2SO_4$ |
|---|---|
| 1027° C. | $p\,SO_2 = 8.60 \times 10^{-7} = 0.86$ ppm $SO_2$ |
| 927° C. | $p\,SO_2 = 2.16 \times 10^{-8} = 0.02$ ppm $SO_2$ |
| 827° C. | $p\,SO_2 = 2.80 \times 10^{-10} = 2.77 \times 10^{-4}$ ppm $SO_2$ |

Lanthanum oxide has been used as a "$SO_x$ gettering" catalyst in Fluid Bed Catalytic Crackers (FCC) in oil refineries for many years and the preference for lanthanum oxide for this type of catalyst is described in the paper by Scherzer, described above.

When the $pSO_2$ necessary to prevent dissociation of $Ce_2(SO_4)_3$ shown in FIG. 3 is compared with $pSO_2$ necessary to prevent the dissociation of $La_2O_2SO_4$ listed in Table II, it can be seen that it requires several orders of magnitude lower $pSO_2$ to prevent dissociation of $La_2O_2SO_4$ than it does to prevent the dissociation of $Ce_2(SO_4)_3$. Therefore, in situations where there is little or no $SO_2$ in the flue gases or $NO_x$ reduction is required at high temperatures, $La_2O_2SO_4$ may be the preferred catalyst.

The phase stability diagram for the La-O-S system indicates that $La_2O_2SO_4$ is the most likely sulfate to form when $La_2O_3$ is exposed to flue gases.

The rate of desulfurization of flue gases with doped and undoped cerium oxide ($CeO_2$) has been investigated. The results of this investigation are shown in Table III. For these experiments the granules of doped and undoped $CeO_2$ were prepared by the Marcilly technique which utilizes the formation of the sorbent from aqueous solutions of a water soluble salt of the lanthanide oxide and citric acid. The solutions are evaporated to the consistency of a thick sugar syrup and are then evaporated to dryness in a vacuum oven operating at approximately 25° C. at 25 inches of vacuum. After evaporation the dried sorbent was pyrolyzed at 400° C. to produce a material in which the dopants are in solid solution in the $CeO_2$.

The doped and updoped $CeO_2$ were then exposed to synthetic flue gases containing 3000 ppm $SO_2$, 3.5% $O_2$, 22% $CO_2$ and 74% for a period of one hour. The weight gained by the sorbents is due to reaction (4) described above. The sorbents with highest rate of weight gain and the greatest weight gain are superior to the ones with lower rates of weight gain and lower total weight gain.

TABLE III

CALCULATED RATE OF WEIGHT GAIN AND TOTAL WEIGHT GAIN AFTER EXPOSURE OF DOPED AND UNDOPED SORBENTS TO FLUE GAS AT 550° C.

| DOPANT | CODE | RATE OF* WT GAIN | TOTAL WT GAIN | % INCREASE RATE OF WT GAIN | % INCREASE TOTAL WT GAIN |
|---|---|---|---|---|---|
| None | 6211-8 | 2.5 | 3.0 mg | — | — |

TABLE III-continued

CALCULATED RATE OF WEIGHT GAIN AND TOTAL WEIGHT GAIN AFTER EXPOSURE OF DOPED AND UNDOPED SORBENTS TO FLUE GAS AT 550° C.

| DOPANT | CODE | RATE OF* WT GAIN | TOTAL WT GAIN | % INCREASE RATE OF WT GAIN | % INCREASE TOTAL WT GAIN |
|---|---|---|---|---|---|
| None(Duplicate) | 6211-8 | 2.5 | 3.0 mg | — | — |
| 5 m/oCaO | 6211-1 | 4.0 | 4.5 mg | 60.0 | 50.0 |
| 10 m/oCaO | 6211-2 | 4.9 | 5.0 mg | 96.0 | 66.7 |
| 5 m/o$La_2O_3$ | 6211-9 | 3.0 | 3.0 mg | 20.0 | 0.0 |
| 10 m/o$La_2O_3$ | 6211-4 | 4.2 | 5.0 mg | 68.0 | 66.7 |
| 5 m/oSrO | 6211-5 | 4.2 | 4.5 mg | 68.0 | 50.0 |
| 10 m/oSrO | 6211-6 | 5.6 | 7.5 mg | 124.0 | 150.0 |

*mg/min/gm
Surface area of sorbents predicted to be 20 $m^3$/gm

Table III above clearly shows the superiority of doped $CeO_2$ to undoped $CeO_2$ for the removal of $SO_2$ from the flue gas streams.

The lanthanide-oxygen-sulfur compound to be used as a catalyst can be impregnated onto the substrate of pellets, granules, Raschig rings, honeycombs, zeolites, or other substrates known to those skilled in the art prior to their installation into ducts through which the gases from which the $NO_x$ is to be removed pass. If and when this catalyst becomes inoperative for any reason, these substrates may be recoated with the aqueous/liquid solutions of the preferred catalyst, and their ability to catalyze the reduction of $NO_x$ will be restored.

EXAMPLE I

A typical analysis of the flue gas from a pulverized coal fired boiler is: 3000 ppm $SO_2$, 13.21% $CO_2$, 3.7% $O_2$, 9.2% $H_2O$, 73.48% $N_2$, and 500 ppm $NO_x$. This flue gas may be exposed to $Ce_2(SO_4)_3$ on a substrate which has been immersed in an aqueous solution containing $Ce_2(SO_4)_3$ and subsequently dried at a temperature sufficiently low to prevent the dissociation of the $Ce_2(SO_4)_3$. Based on the data presented in FIG. 3, when a flue gas containing 3000 ppm $SO_2$ to which at least 750 ppm $NH_3$ has been added is exposed to the substrate containing the $Ce_2(SO_4)_3$ catalyst at a temperature of less than 600° C., 95% reduction of $NO_x$ to $N_2$ is expected.

EXAMPLE II

A typical analysis of the flue gas from a boiler fired with natural gas is: 2–3 ppm $SO_2$, 14.1% $CO_2$, 0.6% $O_2$, 82.1% $N_2$, and 100 ppm $NO_x$ This flue gas, which would also contain 100 ppm CO, may be exposed to a $La_2O_2SO_4$ coating on a substrate. Because of difficulty of dissociation of $La_2O_2SO_4$ at temperatures as high as 1227° C., the chemical composition of the $La_2O_2SO_4$ is expected to be little changed after long time exposure to such flue gases. It is expected that the substrate catalyzes the reduction of the $NO_x$ to $N_2$ as long as its composition was essentially $La_2O_2SO_4$.

EXAMPLE III

The exhaust gases from a gasoline burning internal combustion engine can contain as much 0.70% CO, 0.22% $NO_x$, 0.015% hydro-carbons, and 0.36% $O_2$. If such a gas were passed over a $La_2O_2SO_4$ catalyst on a substrate in the exhaust system of an internal combustion engine, the promoting effect of the catalyst could cause the dissociation of the $NO_x$ to $N_2$ and oxygen. The CO could reduce the oxygen on the active sites of the catalyst making it capable of continuously catalyzing the dissociation of $NO_x$.

However, if insufficient reducing gases are contained in the exhaust gases of the internal combustion engine because of previous catalytic reduction of the reducing agents or the operating parameters of the engine have been controlled to preclude the formation of sufficient amount of reducing gases, additional reducing gases may be added to the exhaust gases to increase their reducing power sufficiently that, when in contact with a lanthanide-oxygen-sulfur compound, the dissociation of the $NO_x$ present in the exhaust gases achieves a $NO_x$ level sufficient to meet present and future requirements for $NO_x$ emissions from internal combustion engines.

Figure 4:
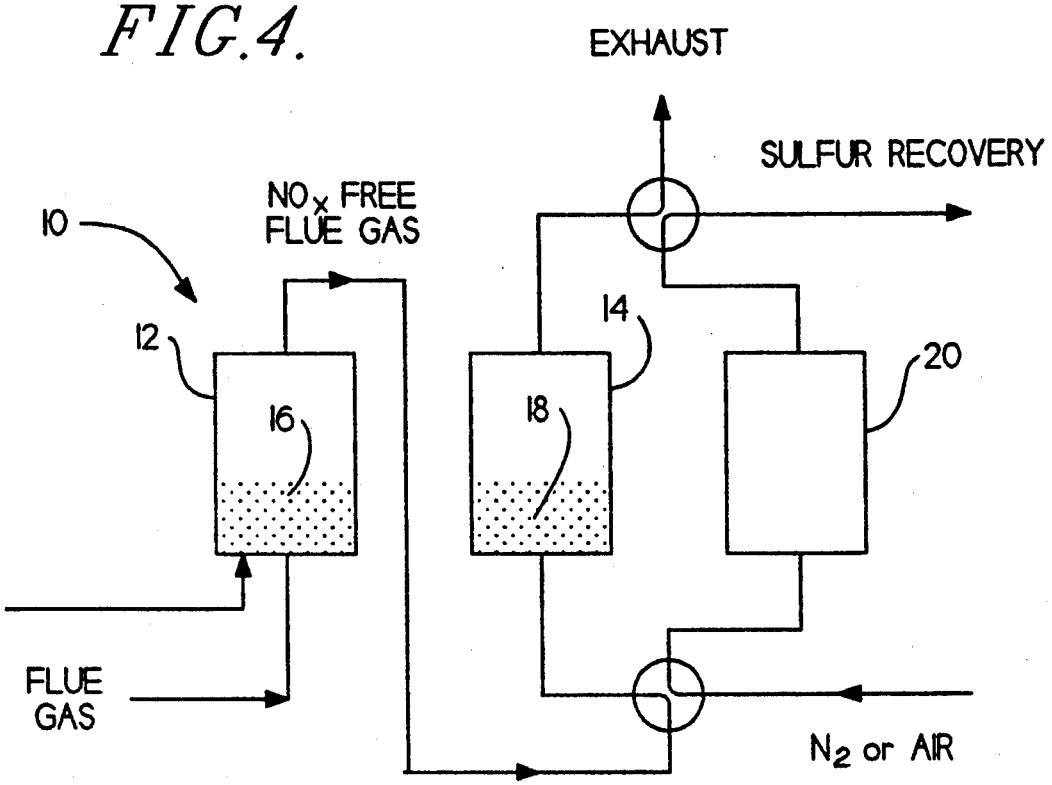
FIG. 4 is a schematic drawing showing a reactor which may be utilized to carry out the process of the present invention.

FIG. 4 shows a schematic of a reactor which may be used with the process of the present invention. FIG. 4 shows a reactor 10 having separate $NO_x$ removal unit 12 and $SO_x$ removal unit 14. $NO_X$ removal unit 12 and $SO_X$ removal unit 14 can utilize any one of a fixed bed, moving bed or fluidized bed construction. $NO_x$ removal unit 12 includes a bed of catalyst 16 over which the flue gases pass. If needed, a reducing gas can also be introduced to $NO_x$ removal unit 12. The flue gases which pass over catalyst 16 are introduced into $SO_x$ removal unit 14 where they pass over lanthanide oxide bed 18. The solid solution of the lanthanide oxide containing altervalent oxides which crystallize in the fluorite habit in lanthanide oxide bed 18 reacts with the flue gases to form a sulfated lanthanide oxide compound. The sulfated lanthanide oxide is regenerated to lanthanide oxide in regeneration unit 20.

Figure 5:
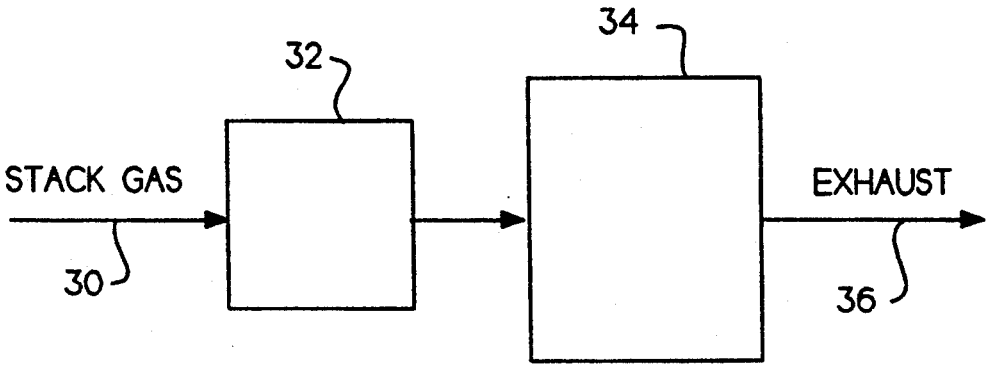
FIG. 5 is a schematic diagram showing the process of the present invention used for removing $NO_X$ from gases created in a boiler or in an internal combustion engine.

FIG. 5 is a schematic of the process for removing $NO_x$ from gases created either from a boiler of a power plant or from an internal combustion engine. When the stack gases 30 contain enough reducing gas to react with the oxygen that accumulates on the active sites of the lanthanum-oxygen sulfur catalyst in $NO_X$ removal unit 32, no additional reducing gas is required.

When the stack gases 30 do not contain enough reducing gas to remove sufficient $NO_X$ to meet environmental requirements, additional reducing gas may be added in excess of the stoichiometric amount necessary to meet the environmental requirements. The reducing gas is added to stack gases 30 at or before $NO_X$ removal unit 32. Excess reducing gas may be removed from the gas stream in the oxidation catalysis unit 34 before the exhaust gases 36 go up the stack.

When there is an excess of reducing gases in the stack gases 30, $NO_X$ is removed by the lanthanum-oxygen-sulfur catalyst in $NO_X$ removal unit 32. The excess reducing gas is removed in oxidation catalysis unit 34.

The present invention can be used in an automotive exhaust control system. In the automotive exhaust system, exhaust gases containing CO, hydrocarbons, and $NO_x$ with a 2–15% level of $O_2$ exit an internal combustion engine. The exhaust gases pass over a lanthanide-sulfur oxygen catalyst which removes the $NO_x$ present in the exhaust gases. The exhaust gases then pass through a conventional CO and hydrocarbon oxidation unit. The resulting exhaust gas is low in CO, $NO_x$ and hydrocarbons.

Church et. al. teaches the removal of $NO_x$ using conventional noble metal catalysts. However, these catalysts are readily poisoned by NO and $O_2$ and do not function in the oxidizing atmosphere of a more efficient lean burning engine. The lanthanide sulfur-oxygen catalysts of the present invention do not encounter the drawbacks experienced by the conventional catalysts. Experimental data indicate that $NO_x$ concentration in the exhaust gas can be decreased by greater than 90% when a stoichiometric amount of $NH_3$ is used with a lanthanide-sulfur oxygen catalyst in the presence of flue gases containing 4% $O_2$and 10% $H_2O$.

Various embodiments and modifications of this invention have been described in the foregoing description and examples, and further modifications are included within the scope of the invention as described by the following claims.

We claim:

1. A process for optimizing the removal of $NO_x$ and $SO_x$ from flue gases comprising the steps of:

(a) initially passing said flue gases over one of a lanthanide sulfate catalyst and a lanthanide oxy-sulfate catalyst in a first reaction vessel, said catalyst having active sites for entrapping oxygen provided on the surface thereof, wherein said active sites promote the dissociation of said $NO_x$ in said flue gases and receive and entrap oxygen released during said dissociation of said $NO_x$;

(b) contacting said catalyst with at least one reducing gas to reduce said oxygen received and entrapped on said active sites of said catalyst to permit said catalyst to continue to promote said dissociation of said $NO_x$ in said flue gases;

(c) subsequently passing said flue gases over a solid solution in a second reaction site in the process, said solid solution comprising a solvent of a first lanthanide-oxygen compound which crystallizes in the fluorite habit and a solute of at least an alternate oxide of at least one of a second lanthanide and an alkaline earth metal wherein said $SO_x$ in said flue gases reacts with said solid solution to form a sulfated lanthanide-oxygen-sulfur compound; and (d) removing said sulfated lanthanide-oxygen-sulfur compound from contact with said flue gases and raising the temperature of said sulfated lanthanide-oxygen-sulfur compound sufficiently high to cause dissociation of said sulfated lanthanide-oxygen-sulfur compound whereby said lanthanide-oxygen compound is regenerated.

2. The process of claim 1 wherein said first reaction site and said second reaction site are different.

3. The process of claim 1 wherein said catalyst is selected according to the temperature at which dissociation of said catalyst occurs, the temperature of said flue gases, and the $SO_x$ content of said flue gases.

4. The process of claim 3 wherein said catalyst is provided on a substrate.

5. The process of claim 4 wherein said substrate is at least one of pellets, granules, Raschig rings, zeolites, and honeycombs.

6. The process of claim 3 wherein said catalyst is deposited on a substrate from liquid solutions in which said catalyst is dissolved.

7. The process of claim 3 wherein the gas necessary to reduce said oxygen from said active sites on said catalyst is selected from the group consisting of carbon monoxide, methane, ammonia and combinations of carbon monoxide, methane and ammonia.

8. The process of claim 3 wherein the amount of reducing gas used is sufficient to provide at least 80% of the stoichiometric amount necessary to reduce said oxygen on said active sites of said catalyst.

9. The process of claim 3 wherein said catalyst is rejuvenated by applying an additional coating of said catalyst by means of a liquid solution of said catalyst to said substitute.

10. The process of claim 3 wherein the catalyst is selected so that is will not dissociate under the combined conditions of said catalyst dissociation temperature, said temperature of said flue gases, and said $SO_2$ content of said flue gases from which $NO_x$ is to be removed.

11. The process of claim 10 wherein the combination of said catalyst dissociation temperature and said $SO_2$ content of said flue gases is selected to prevent the dissociation of $Ce_2(SO_4)_3$.

12. The process of claim 3 wherein said solid solution is provided with oxygen ion vacancies, said oxygen ion vacancies increasing the rate of reaction and the extent of reaction of said solid solution and said $SO_x$.

13. The process of claim 4 wherein said sulfated lanthanide oxide is dissociated by raising the temperature of said sulfated lanthanide oxide to at least 780° C. (1436° F.) in the absence of $SO_x$.

14. The process of claim 3 wherein said at least one reducing gas is added to said flue gases before said flue gases contact said catalyst.

15. The process of claim 3 wherein said at least one reducing gas is a constituent of said flue gases.

16. The process of claim 1 wherein said catalyst used for the reduction of $NO_X$ is $Ce_2(SO_4)_3$.

17. The process of claim 16 wherein the $Ce_2(SO_4)_3$ is formed by the reaction of $CeO_2$ with $SO_2$.

18. The process of claim 17 wherein $CeO_2$ is 90% sulfated to achieve 90% catalytic reduction of $NO_x$.

19. The process of claim 17 wherein $CeO_2$ is 97% sulfated to achieve 96% catalytic reduction of $NO_x$.

20. The process of claim 16 wherein the ability of $CeO_2$ to remove $SO_2$ from flue gas decreases from 99% to 96% before 90% catalytic removal of $NO_x$ occurs.

21. The process of claim 3 wherein said catalyst does not dissociate in the presence of at least 3% $O_2$ in the flue gases when the temperature of the flue gases is below 700° C. (1292° F.) and the $SO_2$ content of the gases is greater than 3000 ppm and when the temperature of the flue gases is less than 400° C. (750° F.) and the $SO_2$ content of the gas is greater than 0.1 ppm.

22. The process of claim 1 wherein the first lanthanide-oxygen compound which crystallizes in the fluorite habit is selected from the group consisting of $CeO_2$, $PrO_2$ and $TbO_2$.

23. The process of claim 1 wherein the first lanthanide-oxygen compound which crystallizes in the fluorite habit is a combination of $CeO_2$, $PrO_2$ and $TbO_2$.

24. The process of claim 1 wherein the first lanthanide-oxygen compound which crystallizes in the fluorite habit is $CeO_2$.

25. A process for the reduction of $NO_x$ from flue gases containing a small but significant quantity of $SO_x$ comprising the steps of:

(a) passing said flue gases over one of a lanthanide sulfur catalyst and a lanthanide oxy-sulfate catalyst, said catalyst having active sites provided on the surface thereof, wherein said active sites promote the dissociation of said $NO_x$ in said flue gases and receive and entrap oxygen released during said dissociation of said $NO_x$;

(b) contacting said catalyst with at least one reducing gas to reduce said oxygen received and entrapped on said active sites of said catalyst to permit said catalyst to continue to promote said dissociation of said $NO_x$ in said flue gases.

26. The process of claim 25 wherein said at least one reducing gas is added to said flue gases before said flue gases contact said catalyst.

27. The process of claim 25 wherein said at least one reducing gas is a constituent of said flue gases.

28. The process of claim 25 wherein said catalyst is selected according to the temperature at which dissociation of said catalyst occurs, the temperature of said flue gases and the $SO_x$ content of the flue gases.

* * * * *

UNITED STATES PATENT AND TRADEMARK OFFICE

CERTIFICATE OF CORRECTION

PATENT NO. : 5,213,779

DATED : May 25, 1993

INVENTOR(S) : D. Alan R. Kay, et al

It is certified that error appears in the above-indentified patent and that said Letters Patent is hereby corrected as shown below:

On the title page, at item [73] the names of the assignees should read as follows:

--Gas Desulfurization Corporation, Pittsburgh, PA and

Electrochem, Inc., Woburn, MA --

Signed and Sealed this

First Day of August, 1995

*Attest:*

*Attesting Officer*

Bruce Lehman

BRUCE LEHMAN

*Commissioner of Patents and Trademarks*